United States Patent [19]

Polanco

[11] 4,021,882

[45] May 10, 1977

[54] REVERSIBLE DOOR PIVOT

[76] Inventor: Ricardo Polanco, 404 Ocean Ave., Brooklyn, N.Y. 11226

[22] Filed: Jan. 15, 1976

[21] Appl. No.: 649,311

[52] U.S. Cl. ..... 16/170; 49/382
[51] Int. Cl.[2] ..... E05D 7/02
[58] Field of Search ..... 16/128 R, 135, 136, 16/170, 149, 171, 151, 168; 49/388, 382

[56] References Cited

UNITED STATES PATENTS

| | | | |
|---|---|---|---|
| 2,938,227 | 5/1960 | Lhota | 16/171 X |
| 2,972,788 | 2/1961 | Shean | 49/388 |
| 3,141,190 | 7/1964 | Reiss | 16/136 X |
| 3,320,699 | 5/1967 | Carson et al. | 49/388 |

FOREIGN PATENTS OR APPLICATIONS

| | | | |
|---|---|---|---|
| 2,002,358 | 10/1969 | France | 16/170 |

*Primary Examiner*—G. V. Larkin
*Attorney, Agent, or Firm*—Allen D. Brufsky

[57] ABSTRACT

A reversible door pivot positionable on either side of a door jamb to permit a hung door to swing in either direction. The pivot includes a standing hinge member having an elongated shank inserted into the jamb and a head projecting exteriorly of the jamb into the door opening. A swinging hinge member fixed to the door has a depending pivot pin rotatably insertable into a central opening in the head of the standing hinge member. A support plate is placed within the jamb in contact with the shank of the standing hinge member.

6 Claims, 4 Drawing Figures

REVERSIBLE DOOR PIVOT

BACKGROUND OF THE INVENTION

This invention relates to a reversible door pivot capable of permitting hinging of the door to swing in either direction.

A door hinge or pivot customarily has a standing member that is fastened on the door frame or jamb adjacent the door opening and a swinging member that is secured to the surface of the door. Means, such as pins and the like, are provided to pivotally connect the standing member to the swinging member.

An example of a hinge having such a construction is the conventional bitt hinge of which two types are made; a right-hand swinging type and a left-hand swinging type. At the time the door is mounted the direction of swing is determined by the type of bitt hinge that is used to hang the door. The direction of swing of such a hinge or pivot cannot be altered nor can the exposed surface of the door be changed.

SUMMARY OF THE INVENTION

Accordingly, it is an object of this invention to provide a reversible door pivot or hinge. A further object of this invention is provide a reversible door pivot or hinge having a standing member, fastened to the door frame or jamb and a swinging member secured to the door wherein the standing member can be mounted on either side of the jamb so that a single door and swinging member may be mounted to swing in or out and either right hand or left hand.

The reversible pivot consists of a standing hinge member; the standing hinge member having an elongated shank adapted to be inserted through a door jamb and a head having an opening therein in abutment with the exterior of the jamb; a suppport plate adapted to positioned within the jamb in supporting contact with the shank; and a swinging hinge member adapted to be fixed to a door, the swinging hinge member having a depending pivot pin rotatably insertable within the opening in the head of the standing hinge member.

BRIEF DESCRIPTION OF THE DRAWING

Further objects and advantages of the present invention will become more apparent from the following description and claims, and from the accompanying drawing, wherein:

DETAILED DESCRIPTION OF THE PREFERRED EMBODIMENT

Figure 1:
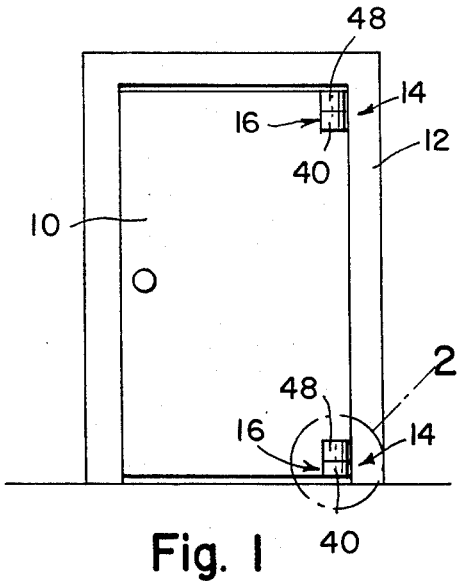
FIG. 1 is a front view in elevation of a door mounted on a jamb by a reversible pivot of the present invention.

Referring now to the drawing in detail, wherein like numerals indicate like elements throughout the several views, a door 10 is illustrated in FIG. 1 mounted for swinging movement on a door jamb 12 by a pair of reversible pivots 14 of the present invention.

Pivot 14 includes a standing or fixed member 16 having an elongated shank 18 which is substantially rectangular in cross-section. Shank 18 fits through rectangular openings 20 and 22 formed in hollow jamb 12. A channel shaped support plate 24 having a pair of thread holes 26 and 28 inserted into the bottom of the jamb 12 into supporting contact with shank 18 of standing member 16. The legs 30, 32 of support plate 24 fit snuggly against the inner walls of jamb 12 and a pair of bolts 34 are threaded through the holes 26, 28 in plate 24 into corresponding threaded holes 36, 38 in the shank 18 of standing member 16.

Standing member 16 includes an enlarged head 40 in abutment with the exterior of jamb 12 which extends into the door opening. Head 40 has a central countersunk opening 42 which receives a bearing 44. The end 46 of head 40 is simi-circular for a purpose described hereinafter.

Figure 2:
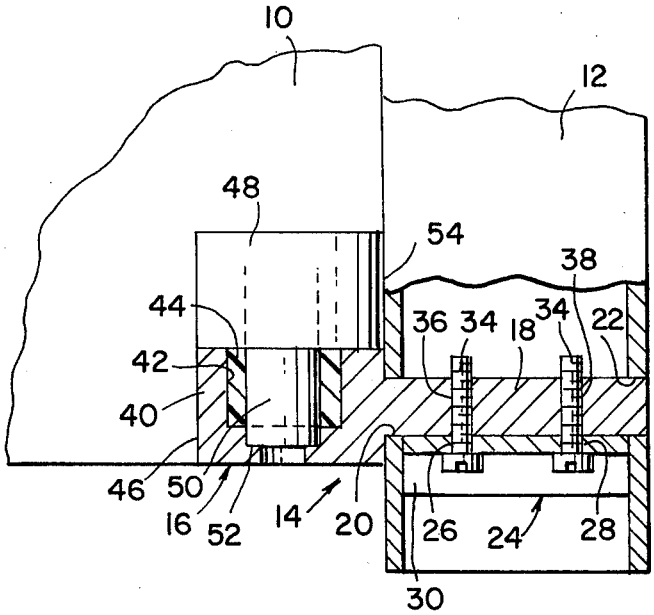
FIG. 2 is an enlarged detail view of the portion of FIG. 1 circled in phantom lines partly in section, and illustrating the reversible pivot of the invention.
Figure 3:
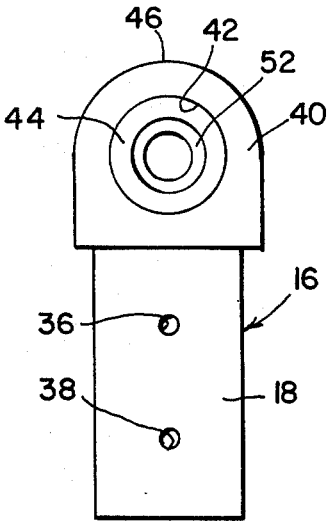
FIG. 3 is a front view in elevation of one of the components of the pivot illustrated in FIG. 2.
Figure 4:
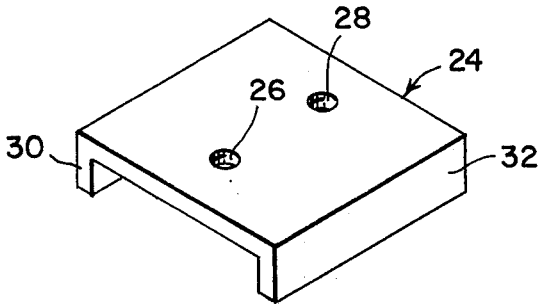
FIG. 4 is a perspective view of another one of the components of the pivot illustrated in FIG. 2.

An upper and lower corner of door 10 is removed and a swinging member 48 having a depending pivot pin 50 is fixed to the door 10 in both corners above the head 40 of standing members 16 of the upper and lower pivot. Sufficient clearance is left between the top of door 10 and the center portion of jamb 12 so that door 10 may be positioned in the door opening formed by jamb 12 and pins 50 slid over the top of heads 40 and dropped into openings 42 into rotational contact with bearings 44. As shown in FIG. 2, the bottom of pins 50 will rest on shoulder 52 of countersunk opening 42 in head 40.

Swinging member 48 has a shape identical to head 40, except end 54 is semi-circular so that the door 10 can rotate and swing in bearings 44 without interference from either head 40 of standing member 16 or swinging member 48.

It will be appreciated that the upper pivot 14 is identical in construction to the lower pivot 14 except that the bolts 34 may be reversed for ready access through the top of the jamb section. Further, the door 10 can be reversed to swing in an opposite direction by mounting the standing members 16 of the pivots 14 on the opposite side of jamb 12.

I claim:

1. A reversible door pivot comprising:

a standing hinge member;

said standing hinge member having an elongated shank adapted to be inserted through a door jamb and a head having an opening therein in abutment with the exterior of said jamb;

a support plate adapted to positioned within said jamb in supporting contact with said shank; and a swinging hinge member adapted to be fixed to a door, said swinging hinge member having a depending pivot pin rotatably insertable within the opening in said head of said standing hinge member.

2. A reversible door pivot in accordance with claim 1 including a bearing within said opening in said head of said standing hinge member.

3. A reversible door pivot in accordance with claim 1 wherein said opening in the head of said standing hinge member is countersunk presenting an annular shoulder to support said pivot pin.

4. A reversible door pivot in accordance with claim 1 wherein opposite ends of the head of said standing hinge member and said swinging hinge member are semi-circular.

5. A reversible door pivot in accordance with claim 1 wherein the shank of said standing hinge member is rectangular in cross-section.

6. A reversible door pivot in accordance with claim 1 wherein said support plate is U-shaped in cross-section, said U-shaped plate being fixed to said shank while the legs of said plate are adapted to fit snugly with the interior walls of said jamb.

* * * * *